US011433415B2

(12) United States Patent
Takeuchi et al.

(10) Patent No.: US 11,433,415 B2
(45) Date of Patent: Sep. 6, 2022

(54) NOZZLE ADAPTER, NOZZLE ADAPTER SET, APPLICATION DEVICE, AND APPLICATION SYSTEM

(71) Applicant: SAKAI DISPLAY PRODUCTS CORPORATION, Sakai (JP)

(72) Inventors: Kenta Takeuchi, Sakai (JP); Chikanori Tsukamura, Sakai (JP)

(73) Assignee: SAKAI DISPLAY PRODUCTS CORPORATION, Sakai (JP)

( * ) Notice: Subject to any disclaimer, the term of this patent is extended or adjusted under 35 U.S.C. 154(b) by 210 days.

(21) Appl. No.: 16/753,262

(22) PCT Filed: Oct. 3, 2017

(86) PCT No.: PCT/JP2017/036026

§ 371 (c)(1),
(2) Date: Jul. 13, 2020

(87) PCT Pub. No.: WO2019/069379

PCT Pub. Date: Apr. 11, 2019

(65) Prior Publication Data

US 2021/0162448 A1 Jun. 3, 2021

(51) Int. Cl.

| | |
|---|---|
| ***B05B 15/65*** | (2018.01) |
| ***B05B 1/02*** | (2006.01) |
| ***B05C 5/02*** | (2006.01) |

(52) U.S. Cl.
CPC ..... *B05B 15/65* (2018.02); *B05B 1/02* (2013.01); *B05C 5/02* (2013.01)

(58) Field of Classification Search
CPC ..... B05B 15/65; B05B 1/02; B05C 5/02
USPC ..... 239/390–394, 548, 550, 600, 750
See application file for complete search history.

(56) References Cited

U.S. PATENT DOCUMENTS

| | | | | |
|---|---|---|---|---|
| 1,554,521 | A * | 9/1925 | Reece | D21G 9/00 239/394 |
| 6,053,434 | A * | 4/2000 | Filipsson | B05B 1/1609 239/551 |
| 2011/0204102 | A1 | 8/2011 | Suhara | |
| 2013/0277457 | A1 | 10/2013 | Mizuno et al. | |
| 2014/0299680 | A1 | 10/2014 | Muller et al. | |
| 2017/0066005 | A1 | 3/2017 | Ikushima | |

FOREIGN PATENT DOCUMENTS

| | | | |
|---|---|---|---|
| CN | 201793148 | U | 4/2011 |
| JP | H03-031876 | Y2 | 7/1991 |
| JP | H05-096221 | A | 4/1993 |
| JP | 2000-117171 | A | 4/2000 |

(Continued)

*Primary Examiner* — Steven J Ganey
(74) *Attorney, Agent, or Firm* — ScienBiziP, P.C.

(57) ABSTRACT

A nozzle adapter comprises a first portion having a first channel; and a second portion having a second channel, a paste material entering the second channel along the first direction and released from the second channel along a second direction, wherein the second portion has a nozzle connecting part, to which a nozzle is connected; a downstream end of the second channel is linked to the nozzle connecting part; the first portion has a hollow part for fitting the second portion, the hollow part being formed along the second direction, or along a third direction; and a downstream end of the first channel is linked to the hollow part.

16 Claims, 9 Drawing Sheets

(56) References Cited

FOREIGN PATENT DOCUMENTS

| | | | |
|---|---|---|---|
| JP | 2002-331262 | A | 11/2002 |
| JP | 2014-131794 | A | 7/2014 |
| WO | 2015/137271 | A1 | 9/2015 |

* cited by examiner

NOZZLE ADAPTER, NOZZLE ADAPTER SET, APPLICATION DEVICE, AND APPLICATION SYSTEM

TECHNICAL FIELD

The invention relates to a nozzle adapter, a nozzle adapter set, an application apparatus, and an application system that can be used at the time of applying a paste material.

BACKGROUND ART

A paste application machine to draw a given pattern on a substrate with a paste material is being used in a process of manufacturing a liquid crystal display panel, for example (see Patent Document 1). As shown in Patent Document 1, the paste application machine comprises a paste housing cylinder in which a paste material is housed, a nozzle support extending horizontally from the paste housing cylinder, and a nozzle being attached downward to the tip of the nozzle support. In general, the nozzle is attached thereto by screwing a male screw being provided in the nozzle into a female screw of the nozzle support.

PRIOR ART DOCUMENT

Patent Document

Patent Document 1: JP 2000-117171A

SUMMARY OF THE INVENTION

Problem to be Solved by the Invention

However, at the time of drawing with a paste material onto a substrate using a conventional paste application machine, a failure in applying the paste material occurs, such as an occurrence of a nozzle clogging in a nozzle support or discontinuous paste material during drawing of the paste material.

Thus, in light of such problems as described above, an object of the present invention is to provide a nozzle adapter, a nozzle adapter set, an application apparatus, and an application system that can suppress a failure in applying a paste material.

Means to Solve the Problem

As a result of carrying out intensive studies repeatedly to overcome the above-described problems, the inventors have found that the above-mentioned application failure occurs in a paste application machine in a case that a new nozzle is connected to a nozzle support in which a paste material remains in a channel and found that the cured material of the paste material is produced at the time of connecting the nozzle to the nozzle support. Based on such original findings, the inventors presumed that the cured material is produced by connecting the nozzle to the nozzle support and a failure in applying the paste material is caused by the cured material entering a channel of the nozzle support, resulting in completing the invention.

A nozzle adapter according to one Embodiment of the invention comprises, a first portion having a first channel in which a paste material to be passed through the first portion is to flow along a first direction, and a second portion having a second channel a paste material to be passed through the second portion entering the second channel along the first direction, the paste material entered being released from the second channel along a second direction, wherein the second portion has a nozzle connecting part to which a nozzle for discharging, along the second direction, the paste material entered is connected, a downstream end of the second channel is linked to the nozzle connecting part such that the second portion communicates with the nozzle in a case that the nozzle is attached to the second portion, the first portion has a hollow part for fitting the second portion, the hollow part being formed along the second direction, or along a third direction being perpendicular to the first direction and the second direction, and a downstream end of the first channel is linked to the hollow part such that the downstream end of the first channel joins to an upstream end of the second channel of the second portion in a case that the second portion is fitted into the hollow part.

Moreover, a nozzle adapter set according to one Embodiment of the invention comprises, a first portion having a first channel in which a paste material to be passed through the first portion is to flow along a first direction, and a second portion having a second channel, a paste material to be passed through the second portion entering the second channel along the first direction, the paste material entered being released from the second channel along a second direction, wherein the second portion has a nozzle connecting part to which a nozzle for discharging, along the second direction, the paste material entered is connected, a downstream end of the second channel is linked to the nozzle connecting part such that the second portion communicates with the nozzle in a case that the nozzle is attached to the second portion, the first portion has a hollow part for fitting the second portion, the hollow part being formed along the second direction, or along a third direction being perpendicular to the first direction and the second direction, and a downstream end of the first channel is linked to the hollow part such that the downstream end of the first channel joins to an upstream end of the second channel of the second portion in a case that the second portion is fitted into the hollow part.

Furthermore, an application apparatus according to one Embodiment of the invention holds the first portion of the nozzle adapter or the nozzle adapter set such that the second direction corresponds to a vertically downward orientation.

Moreover, an application system according to one Embodiment of the invention comprises the above-mentioned application apparatus and a moving mechanism, wherein the moving mechanism changes the relative position between the nozzle adapter or the nozzle adapter set and a subject onto which the paste material is to be applied via the nozzle adapter or the nozzle adapter set in at least one of a horizontal direction and a vertical direction.

Effects of the Invention

The nozzle adapter, the nozzle adapter set, the application apparatus, and the application system according to the invention can suppress producing of the cured material of a paste material, making it possible to suppress a failure in applying the paste material.

EMBODIMENT FOR CARRYING OUT THE INVENTION

Below, with reference to the drawings, a nozzle adapter, a nozzle adapter set, an application apparatus, and an application system according to one Embodiment of the invention will be explained. The nozzle adapter, the nozzle adapter set, the application apparatus, and the application system according to the invention are not limited to the below-described Embodiment.

Figure 1:
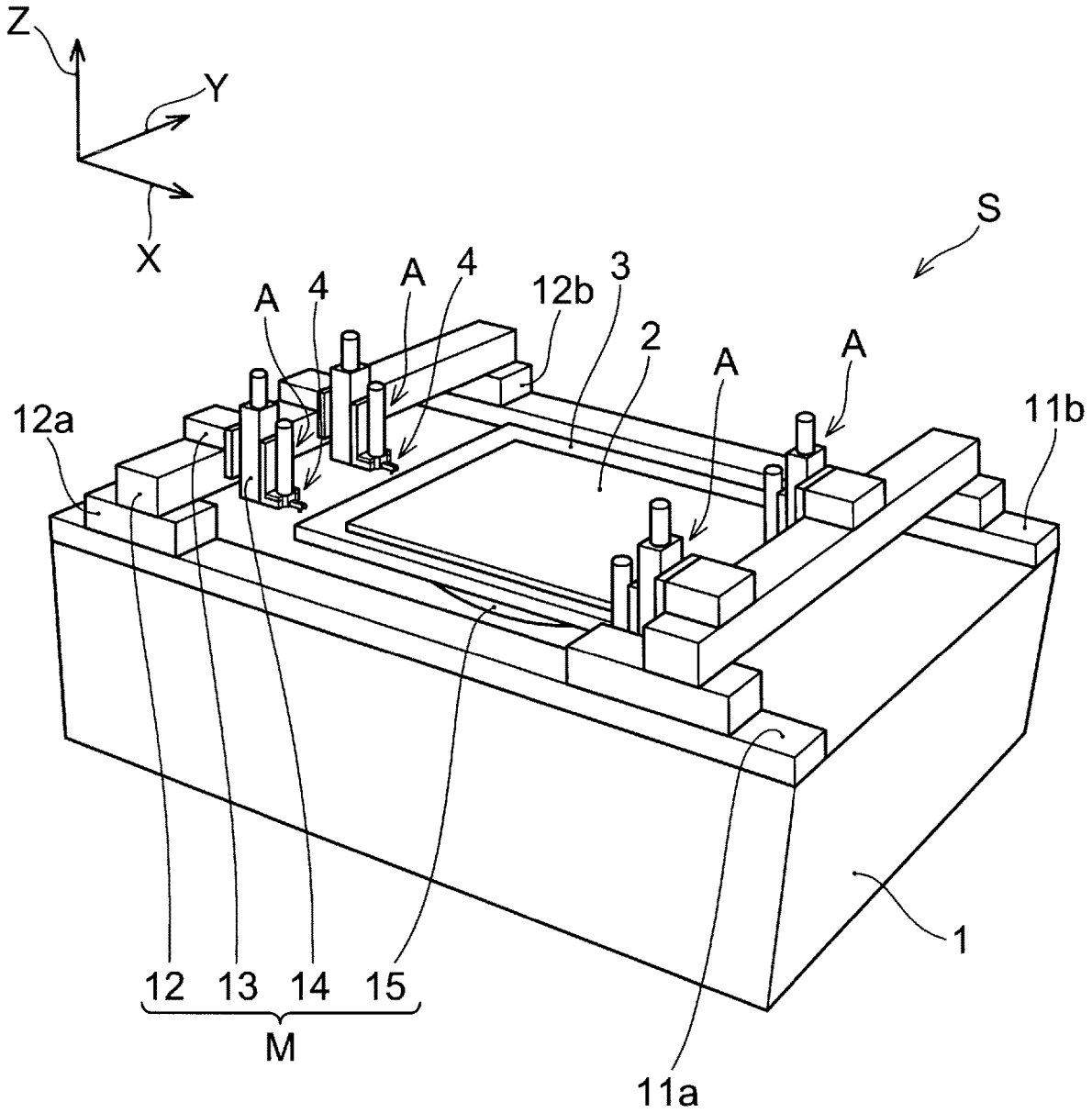
FIG. 1 schematically shows a perspective view of an application system comprising a nozzle adapter according to one Embodiment of the invention.

FIG. 1 schematically shows an application system S according to one Embodiment of the invention. The application system S applies a paste material in a given pattern onto a subject via a nozzle for discharging the paste material.

The paste material is a material for use in a sealing material or a conductive paste. The paste material may be a thermosetting resin or an ultraviolet-curing resin for use in sealing between members, for example.

A subject to be applied with the paste material is construed to be not particularly limited. The above-mentioned subject may be, for example, a substrate for a light-emitting panel such as a liquid crystal panel, a plasma display panel, and an organic-EL panel. In the Embodiment, the subject is a glass substrate. Below, explanations will be given with the substrate being exemplified as the above-mentioned subject.

In the embodiment, as shown in FIG. 1, the application system S comprises, on a frame 1, a supporting body 3 on which a substrate 2 is placed. The application system S further comprises an application apparatus A comprising a nozzle adapter 4 to be described later (see FIG. 3). The application apparatus A is driven to allow a paste material to be applied onto the substrate 2 being placed on the supporting body 3 via a nozzle N (see FIG. 2), the nozzle N being attached to the nozzle adapter 4. Moreover, the application system S comprises a moving mechanism M. The moving mechanism M is driven to move the application apparatus A and the supporting body 3, causing the relative position between the nozzle adapter 4 and the substrate 2 in at least one of the horizontal direction and the vertical direction to be changed. Driving the application apparatus A while driving the moving mechanism M causes the relative position between the substrate 2 and the nozzle N being attached to the nozzle adapter 4 to be changed, and allows the paste material to be applied onto the substrate 2 with the application apparatus A. This allows drawing of the paste material (applying the paste material in a given pattern) onto the substrate 2 to be carried out.

Figure 3:
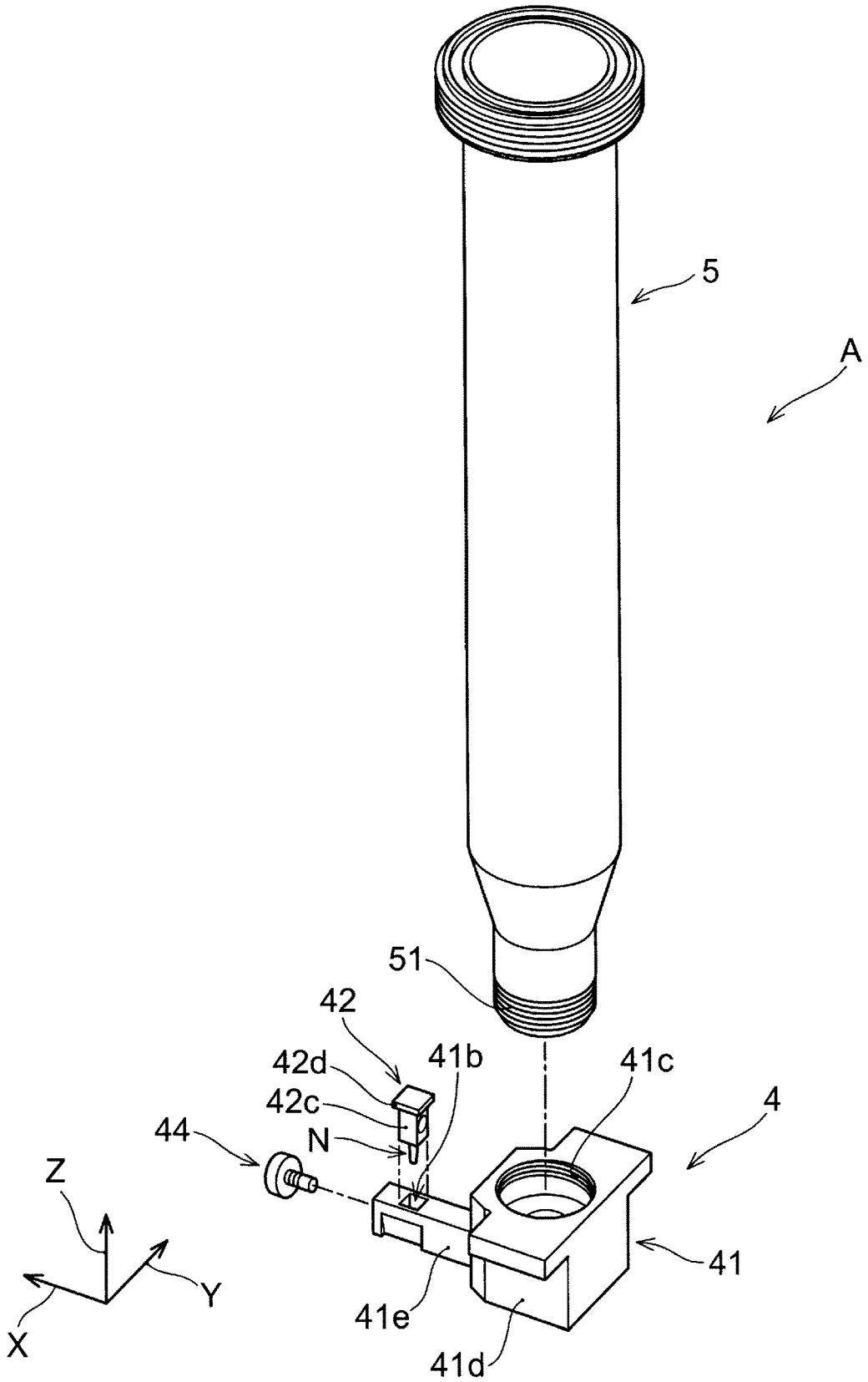
FIG. 3 shows an exploded perspective view of an application apparatus comprising the nozzle adapter according to one Embodiment of the invention.

The structure of the application apparatus A to apply the paste material onto the substrate 2 is not limited to what is shown. In the Embodiment, as shown in FIG. 3, the application apparatus A comprises the nozzle N, the nozzle adapter 4, and a storage portion 5 for storing a paste material. While details of the nozzle adapter 4 will be described later, in the Embodiment, the nozzle N is detachably attached to the nozzle adapter 4 and the storage portion 5 is detachably attached to the nozzle adapter 4.

The interior of the storage portion 5 communicates with the interior of the nozzle N via a below-described channel being formed in the nozzle adapter 4. In the Embodiment, the storage portion 5 is a cylindrical syringe as shown in FIG. 3. The paste material being filled into the storage portion 5 is pressurized and discharged downward in Figures from a discharge opening of the nozzle N. Pressurizing of the paste material may be carried out using a plunger, or may be carried out by pressurizing the interior of the storage portion 5 using an air pressurizing portion (not shown) being connected to the storage portion 5. In the Embodiment, the application apparatus A may further comprise a pressurizing portion. The configuration of the pressurizing portion to be used in the Embodiment is not particularly limited. For example, the pressurizing portion may be a compressor to send compressed air or nitrogen gas to the interior of the storage portion 5 via a tube being connected to the storage portion 5.

In the Embodiment, the application system S comprises a plurality of application apparatuses A as shown in FIG. 1. However, the number of application apparatuses A to be provided in the application system S may be one or a plurality.

The moving mechanism M changes the relative position between the nozzle adapter 4 and the substrate 2 in at least one of the horizontal direction and the vertical direction. When the moving mechanism M is driven, the application apparatus A is moved and the supporting body 3 is rotated. The moving mechanism M, for example, can move the application apparatus A to change the relative position between the nozzle adapter 4 and the substrate 2. Further, the moving mechanism M can move and/or rotate the supporting body 3, on which the substrate 2 is supported, to change the relative position between the nozzle adapter 4 and the substrate 2.

In the Embodiment, the moving mechanism M is configured to move the application apparatus A along an X-axis, and/or a Y-axis being perpendicular to the X-axis. Moreover, the moving mechanism M is configured to move/rotate the supporting body 3 along a horizontal plane defined by the X-axis and the Y-axis and move/rotate the substrate 2 being supported to the supporting body 3. The moving mechanism M moves the application apparatus A and rotates the substrate 2 to change the relative position between the nozzle adapter 4 and the substrate 2 in the horizontal direction. Therefore, it is possible to draw a given pattern with the paste material onto the substrate 2. Moreover, in the Embodiment, the moving mechanism M is configured to move the application apparatus A along a Z-axis being perpendicular to the horizontal plane including the X-axis and the Y-axis. The moving mechanism M moves the application apparatus A along the Z-axis to change the relative position between the nozzle adapter 4 and the substrate 2 in the vertical direction. Therefore, it is possible to adjust the height of the nozzle N, which is provided in the application apparatus A, relative to the substrate 2.

With respect to the moving mechanism M, more specifically, as shown in FIG. 1, a first guiding portion 11*a* and a second guiding portion 11*b* are arranged in substantially parallel with each other along the X-axis on the frame 1. The first guiding portion 11*a* and the second guiding portion 11*b* are spaced apart from each other in the Y-axis direction. A moving body 12 extending along the Y-axis is provided so as to connect the first guiding portion 11*a* and the second guiding portion 11*b*. The moving body 12 is connected, via a sliding member 12*a* and a sliding member 12*b*, to the first guiding portion 11*a* and the second guiding portion 11*b*, respectively. The sliding member 12*a* and the sliding member 12*b* are driven by an X-axis drive portion (not shown) such as a motor to be responsible for movement along the X-axis and the sliding member 12*a* and the sliding member 12*b* move along the first guiding portion 11*a* and the second guiding portion 11*b*, respectively. When the sliding member 12*a* and the sliding member 12*b* move along the X-axis, the moving body 12 moves in the X-axis direction. When the moving body 12 moves in the X-axis direction, the application apparatus A attached to the moving body 12 moves along the X-axis.

The application apparatus A is attached to the moving body 12 so as to be movable along the Y-axis. More specifically, the application apparatus A is attached to the moving body 12 via an attaching member 13. The attaching member 13 is driven by a drive portion (not shown) such as a motor to be responsible for movement along the Y-axis to move in the Y-axis direction along the moving body 12. In the Embodiment, the application apparatus A is attached to the moving body 12 (the attaching member 13) so as to be movable along the Z-axis. More specifically, the application apparatus A is attached to the attaching member 13 via an elevating member 14. The elevating member 14 is driven by a Z-axis drive portion such as a motor not shown to move in the Z-axis direction along the attaching member 13. A rotating table 15 to rotate around the Z-axis is provided beneath the supporting body 3. The rotating table 15 is driven by the Z-axis drive portion (not shown) such as a motor to thereby rotate the supporting body 3, which is held to the rotating table 15, around the Z-axis.

In addition to rotational movement, the supporting body 3 may move linearly on the horizontal plane or may move along the Z-axis. In other words, in the Embodiment, the application system S may further have a mechanism as one of the moving mechanisms M to linearly move the rotating table 15 to realize such a movement. In the Embodiment, movement of the application apparatus A and/or the supporting body 3 in the above-mentioned horizontal direction (X-axis direction, Y-axis direction) and movement of the application apparatus A and/or the supporting body 3 in the vertical direction (Z-axis direction) are controlled by a control device not shown. The control device can control various operations in the application system S, such as application of the paste material by the application apparatus A, besides control of the control mechanism M.

As long as the moving mechanism M can change the relative position between the nozzle adapter 4 and the substrate 2 in at least one of the horizontal direction and the vertical direction, the configuration of the moving mechanism M is not limited to the above-described configurations.

Figure 2:
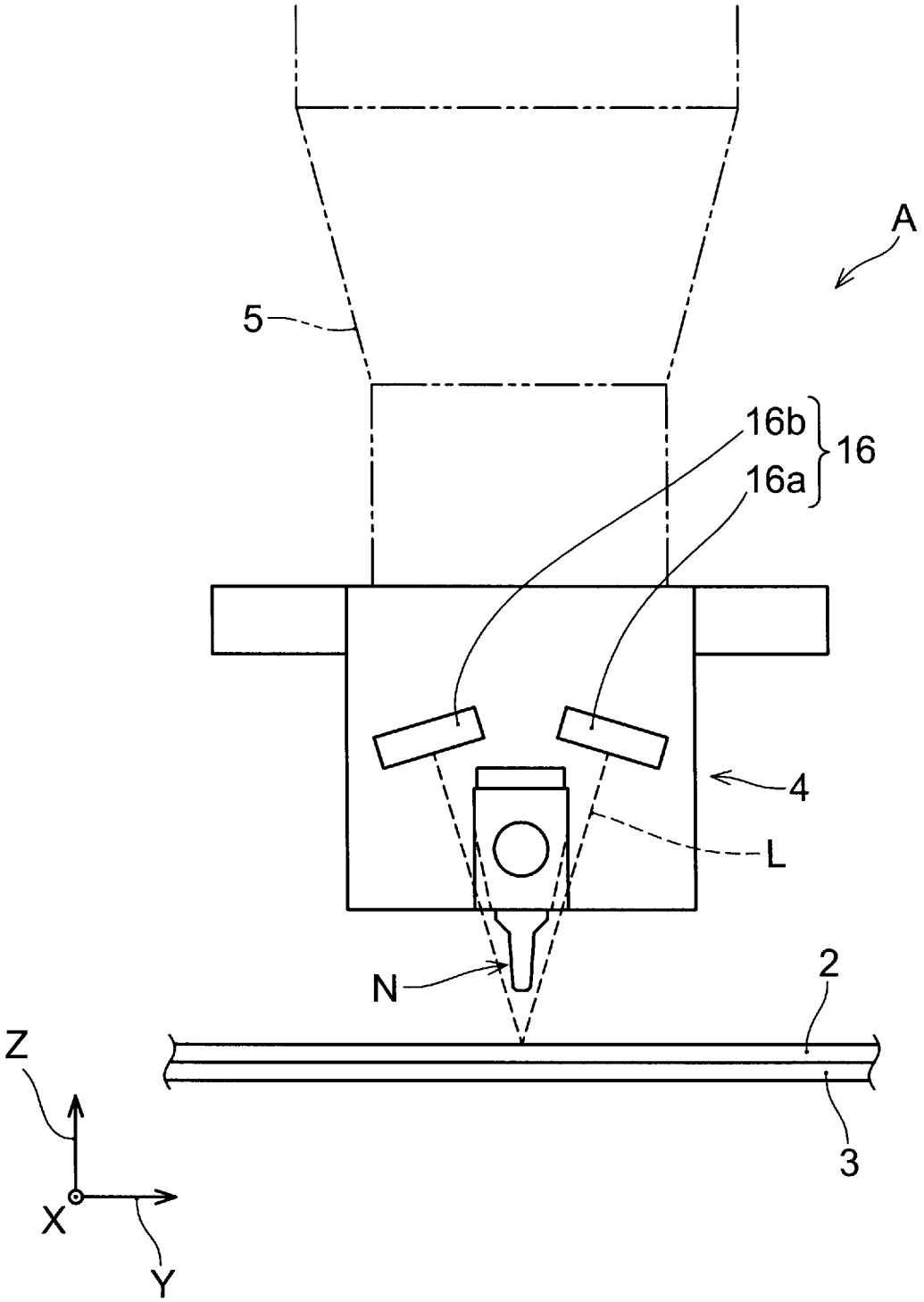
FIG. 2 schematically shows a distance meter being provided in the application system according to one Embodiment of the invention.

Moreover, in the Embodiment, the application system S comprises a distance meter 16 (see FIG. 2) to measure the distance in the vertical direction between the substrate 2 and the nozzle N being attached to the application apparatus A. The distance meter 16 comprises a light-emitting portion 16*a* and a light-receiving portion 16*b* as shown in FIG. 2, for example. A laser light L being irradiated toward the substrate 2 from the light-emitting portion 16*a* is reflected by the substrate 2. The laser light L being reflected by the substrate 2 is received in the light-receiving portion 16*b*. The light-receiving portion 16*b* has a plurality of light-receiving elements (not shown) being provided side by side, for example. The distance between the nozzle N and the substrate 2 is measured based on the position of the light-receiving element receiving the laser light L. The moving mechanism M is driven in accordance with the measured distance between the nozzle N and the substrate 2 to adjust the height of the nozzle N relative to the substrate 2.

Next, the nozzle adapter 4 will be explained. The nozzle adapter 4 is a member to assist in coupling the nozzle N to the application apparatus A. In the Embodiment, the nozzle adapter 4 is coupled to the storage portion 5 in which a paste material can be stored. The paste material stored is supplied to the nozzle N, which is attached to the nozzle adapter 4, via a channel formed in the nozzle adapter 4. While the nozzle adapter 4 is shown in a state in which the nozzle N is attached to the nozzle adapter 4 in FIGS. 2 to 8, "the nozzle adapter" can be one to which the nozzle N is not being attached, or one to which the nozzle N is being attached. The specific structure of the nozzle N is not particularly limited as long as the nozzle N can discharge the paste material. The nozzle N is made of a metal in the Embodiment, however, material for the nozzle N is not particularly limited. For example, the nozzle N can be made of a resin.

As shown in FIG. 3 to FIG. 6(B), the nozzle adapter 4 comprises a first portion 41 and a second portion 42. The first portion 41 has a first channel 41*a* in which a paste material to be passed through the first portion is to flow along a first direction D1. The second portion 42 has a second channel 42*a*. A paste material to be passed through the second portion enters the second channel 42*a* along the horizontal direction (first direction D1) and the paste material entered is released from the second channel 42*a* along the vertical direction (a second direction D2) (see FIG. 6 (A)). The first portion 41 has a hollow part 41*b* for fitting the second portion 42. The first portion 41 and the second portion 42 are preferably made of a metal. However, material for the first portion 41 or the second portion 42 is not particularly limited. The first portion 41 and the second portion 42 may be made of a resin. A "nozzle adapter set" is intended to be a form of a kit into which a plurality of members associated with the nozzle adapter are packaged. In the specification, an assembled structure using a part or all of members of the above-mentioned kit may be also called the "nozzle adapter set". In the nozzle adapter set, the second portion 42 does not have to be attached to the first portion 41, and other members such as a below-described third portion 43, instead of the second portion 42, may be attached to the first portion 41. In other words, the structure (the nozzle adapter) in which the second portion 42 is being attached to the first portion 41 as well as the structure in which the third portion 43 is being attached to the first portion 41 are also categorized as the "nozzle adapter set".

Figure 5:
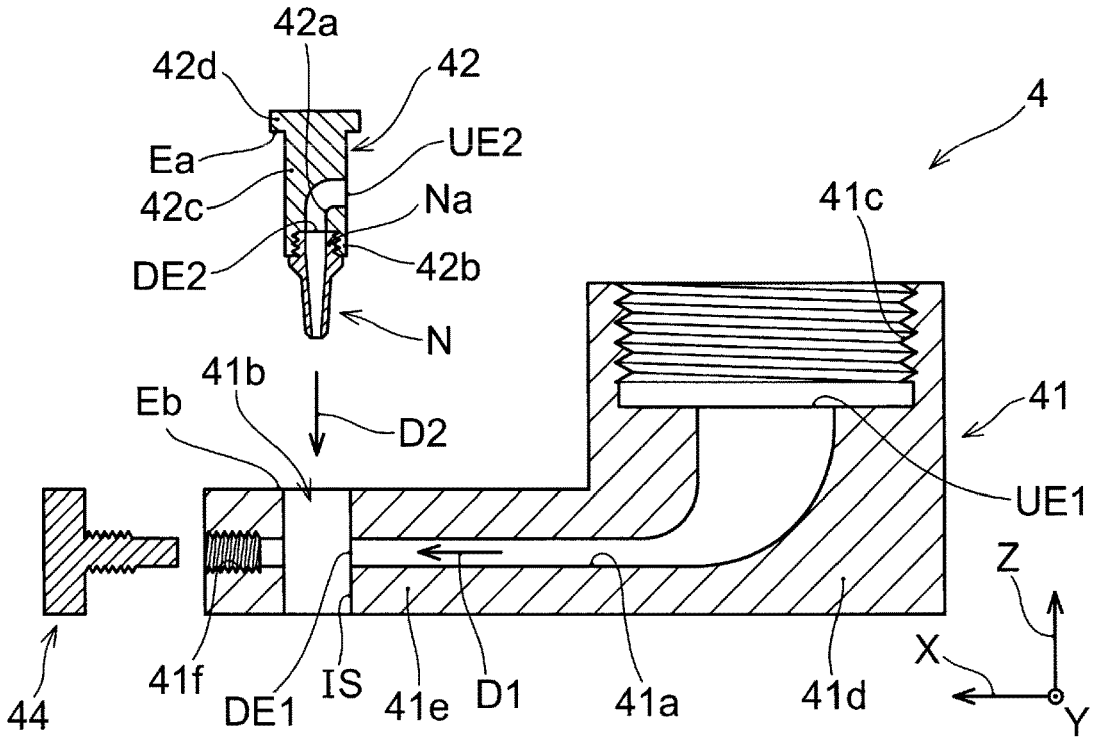
FIG. 5 shows a lateral cross-sectional view along a line V-V of FIG. 4.

In the Embodiment, as shown in FIGS. 3 and 5, the first portion 41 has a coupling part 41*c* to be connected to the storage portion 5 for storing a paste material. The structure of the coupling part 41*c* is not particularly limited as long as the first portion 41 and the storage portion 5 can be coupled such that the interior of the storage portion 5 and the interior of the first portion 41 (the first channel 41*a*) are communicated. In the Embodiment, the coupling part 41*c* has a female screw, an end 51 of the storage portion 5 has a male screw. The first portion 41 and the storage portion 5 are coupled when the female screw (the coupling part 41*c*) and the male screw (the end 51) are screwed together. While it is configured such that the nozzle adapter 4 and the storage portion 5 may be separated in the Embodiment, the first portion 41 may be integrally formed with the storage portion 5.

Figure 4:
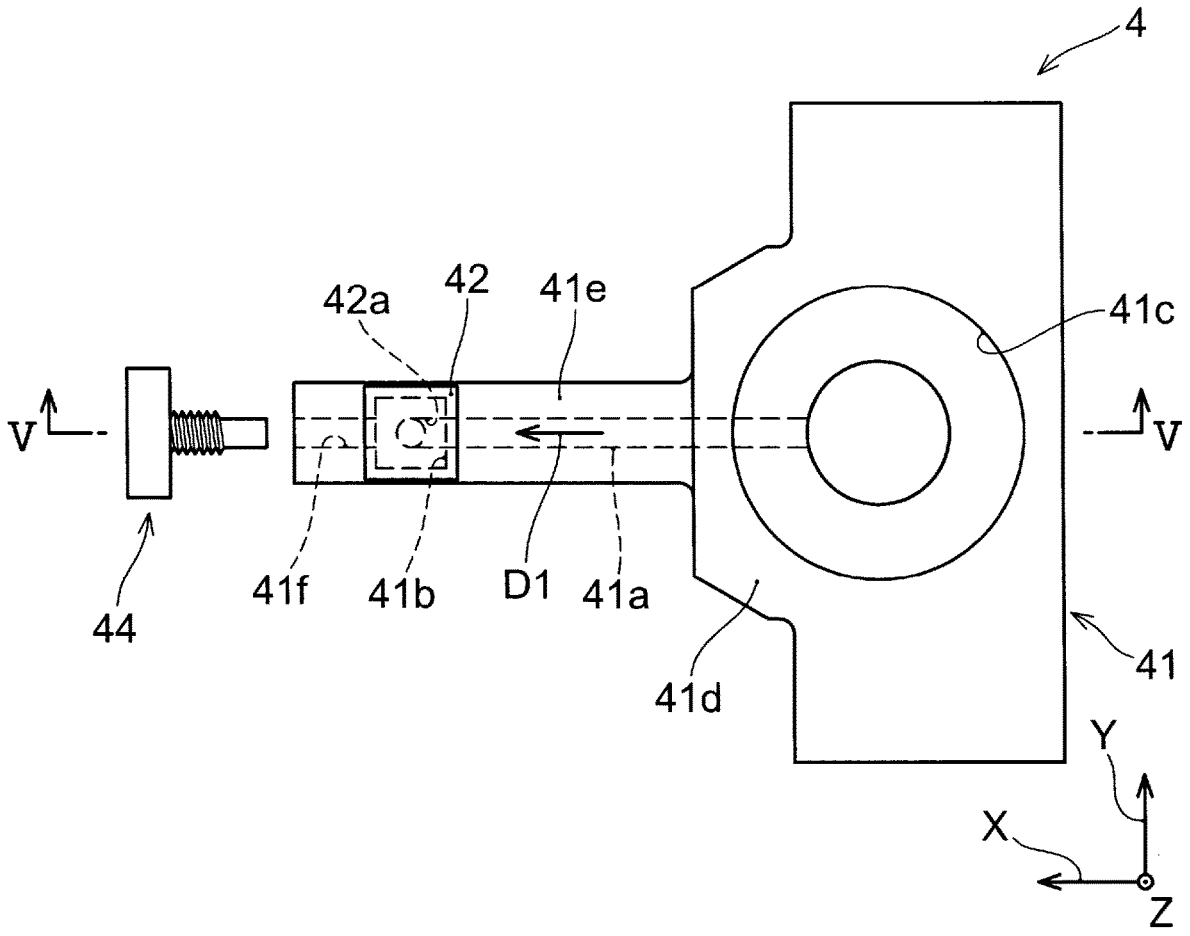
FIG. 4 shows a top view of the nozzle adapter being shown in FIG. 3.

In the Embodiment, as shown in FIGS. 3 to 5, the first portion 41 is configured such that an arm 41*e* having the first channel 41*a* extends horizontally from a block-shaped base 41*d* having the coupling part 41*c*. In the Embodiment, a cross section of the arm 41*e*, the cross section being perpendicular to the direction (the first direction D1) in which the arm 41*e* extends, is substantially rectangular. The arm 41*e* has the hollow part 41*b* penetrating the arm 41*e* along the second direction D2. The first direction D1 is the longitudinal direction of the arm 41*e*. In the Embodiment, as shown in FIGS. 2 and 3, in the cross section of the arm 41*e* cut perpendicular to the first direction D1, the arm 41*e* is notched so as to have a shape being tapered in a vertically downward orientation (in the second direction D2). The arm 41*a* having such a configuration makes it possible to reduce the distance in the horizontal direction between the light-emitting portion 16*a* and the light-receiving portion 16*b* of the distance meter 16 or the distance in the vertical direction between the distance meter 16 and the substrate 2.

As long as the first portion 41 has the channel 41*a*, the hollow part 41*b* into which the second portion 42 or the below-described third portion 43 is to be fitted, and a structure that can fix the second portion 42 or the below-described third portion 43, the shape of the first portion 41 is not limited to the shape shown.

Figure 6A:
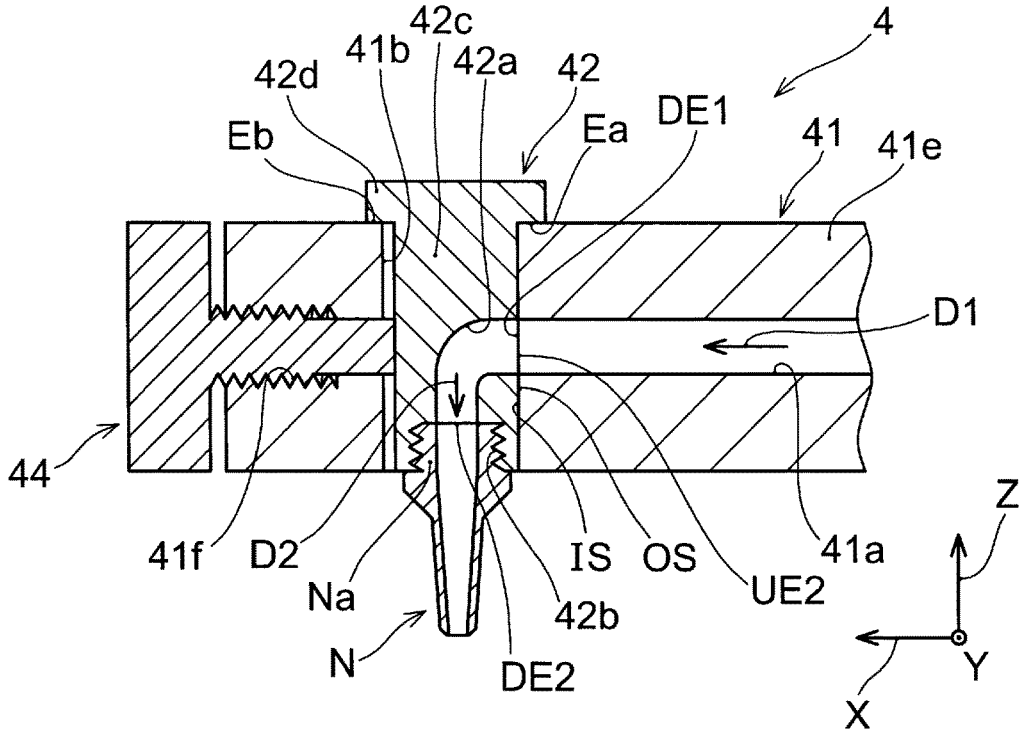
FIG. 6(A) shows a lateral cross-sectional view illustrating a state in which a second portion of the nozzle adapter shown in FIG. 5 is fitted from the above into a hollow part of a first portion.
Figure 6B:
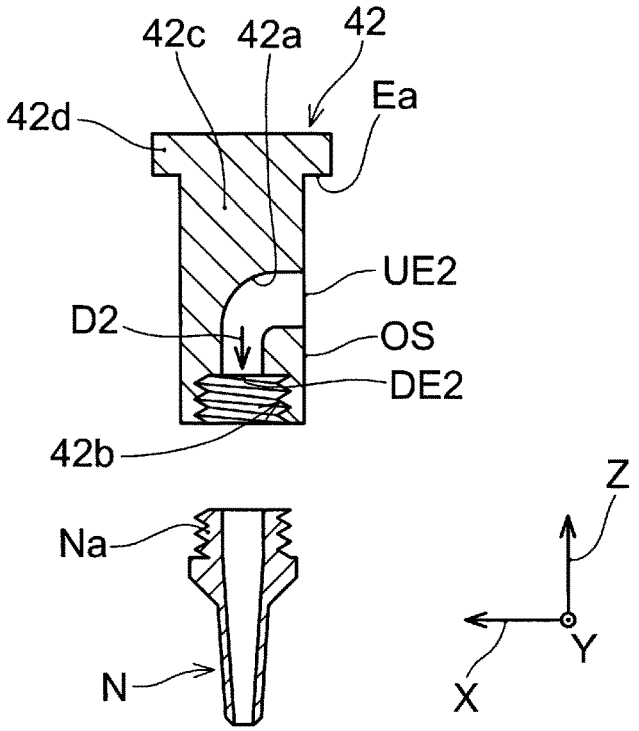
FIG. 6(B) shows a lateral cross-sectional view illustrating a state in which a nozzle is detached from the second portion shown in FIG. 6(A).

When the second portion 42 is fitted into the hollow part 41*b* of the first portion 41, the first channel 41*a* of the first portion 41 is located upstream of the second channel 42*a* of the second portion 42 in the flow direction of the paste material when the paste material is applied. When the application apparatus A is driven with the nozzle N being attached to the nozzle adapter 4 shown in FIG. 6(A), the paste material entered is discharged from the discharge opening of the nozzle N via the first channel 41*a* of the first portion 41 and the second channel 42*a* of the second portion 42. In the Embodiment, as shown in FIG. 1 and FIG. 6(A), the first portion 41 is being held to the application apparatus A such that the second direction D2 corresponds to the vertically downward orientation. In the Embodiment, the first direction D1 is the horizontal direction (the X-axis direction) in the first portion 41 being assembled into the application system S. In the Embodiment, the first direction D1 is substantially perpendicular to the second direction D2. However, the first direction D1 may be inclined relative to the direction being perpendicular to the second direction D2 as long as the paste material passing through the first channel 41*a* can be supplied to the second channel 42*a*.

The first channel 41*a* is a channel in the first portion 41 to supply, to the nozzle N, a paste material being filled into the storage portion 5. In the Embodiment, as shown in FIG. 5, an upstream end UE1 of the first channel 41*a* is linked to the coupling part 41*c* such that the upstream end UE1 of the first channel 41*a* joins to the downstream end of the storage portion 5 in a case that the storage portion 5 is connected to the coupling part 41*c*. This makes it possible to supply the paste material to the first channel 41*a* from the storage portion 5. As shown in FIG. 5 and FIG. 6(A), a downstream end DE1 of the first channel 41*a* is linked to the hollow part 41*b* such that the downstream end DE1 of the first channel 41*a* joins to an upstream end UE2 of the second channel 42*a* of the second portion 42 in a case that the second portion is fitted into the hollow part 41*b*. This makes it possible to supply the paste material entered to the second channel 42*a* from the first channel 41*a*. In the Embodiment, the first channel 41*a* is curved, so that the direction in which the paste material entered flows changes between a given region from the upstream end UE1 of the first channel 41*a* and a given region from the downstream end DE1 of the first channel 41*a*. The specific shape of the first channel 41*a* is not particularly limited as long as the first channel 41*a* penetrates the first portion 41 and the downstream end DE1 is opened toward the first direction D1.

Figure 7:
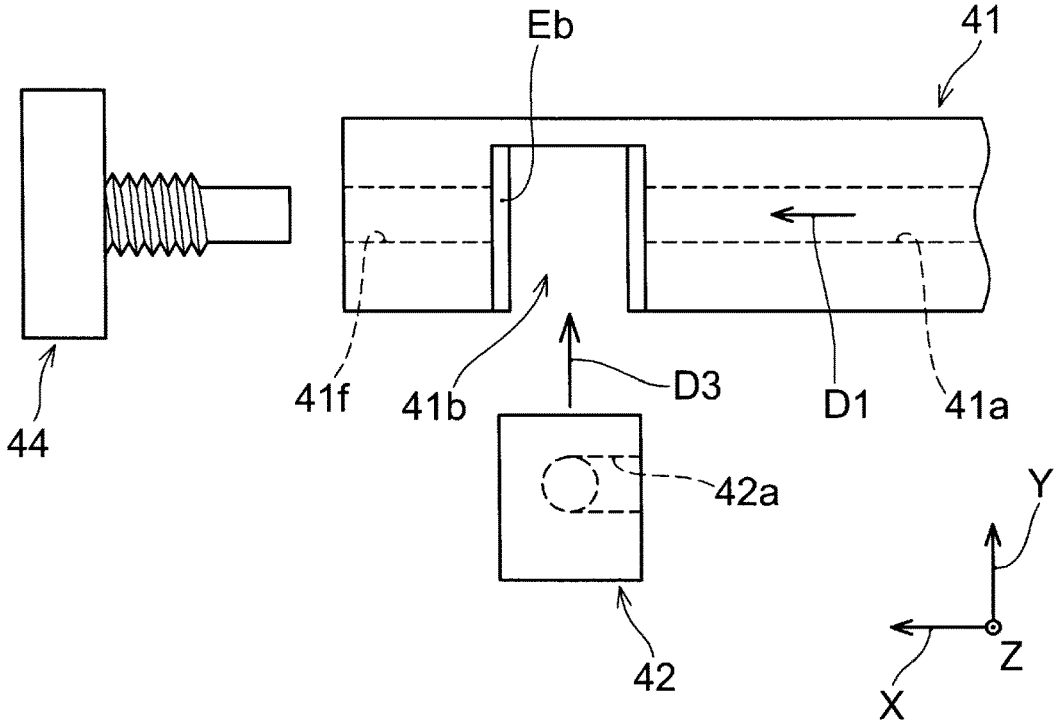
FIG. 7 shows a top view of a variation of the first portion and the second portion of the nozzle adapter according to one Embodiment of the invention.
Figure 8A:
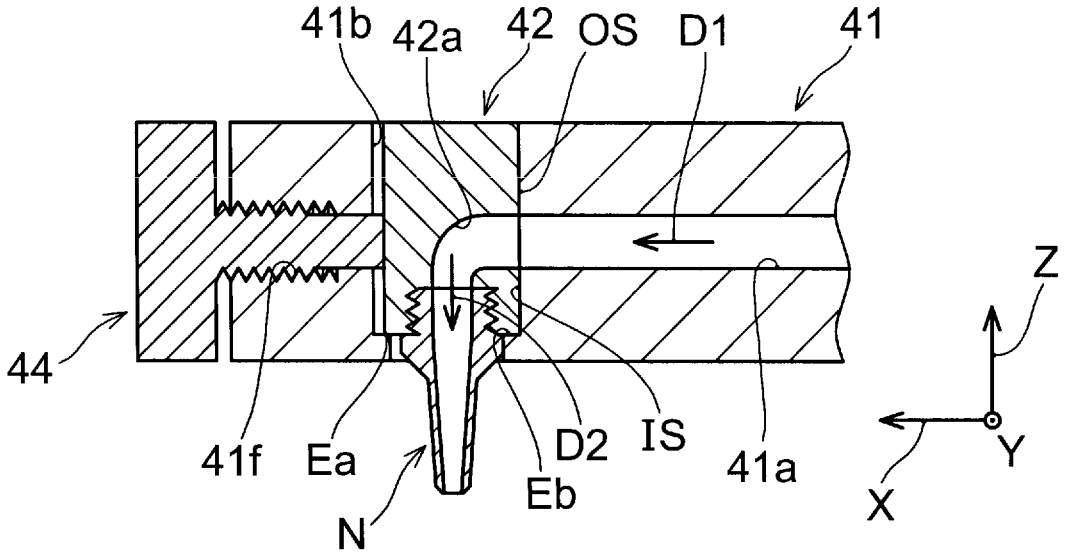
FIG. 8(A) shows a lateral cross-sectional view illustrating a state in which the second portion of the nozzle adapter shown in FIG. 7 is laterally fitted into a hollow part of the first portion.
Figure 8B:
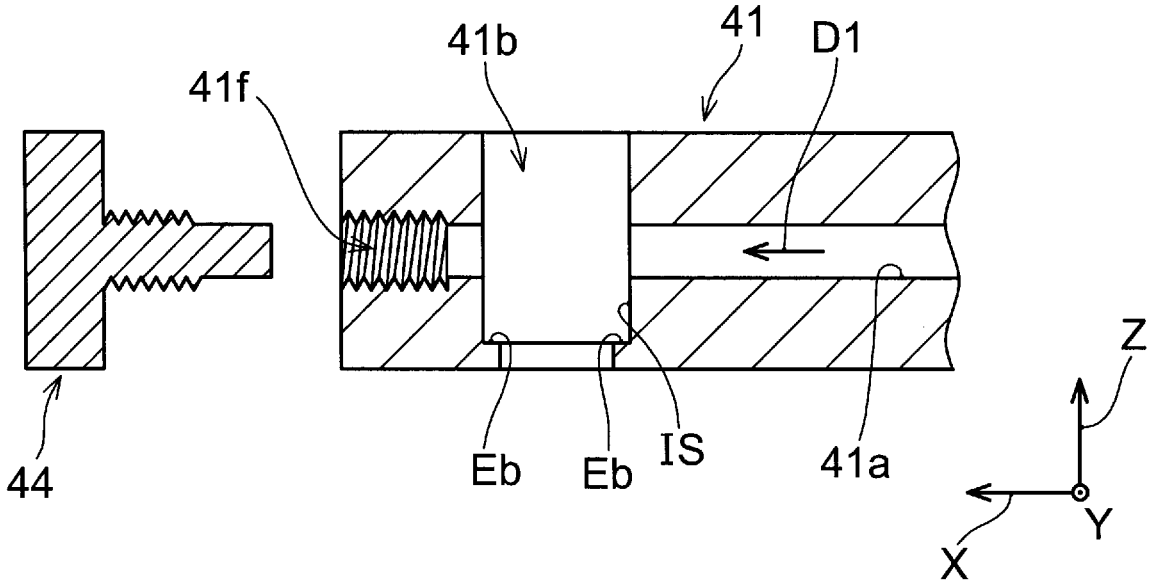
FIG. 8(B) shows a lateral cross-sectional view of the nozzle adapter shown in FIG. 7.
Figure 8C:
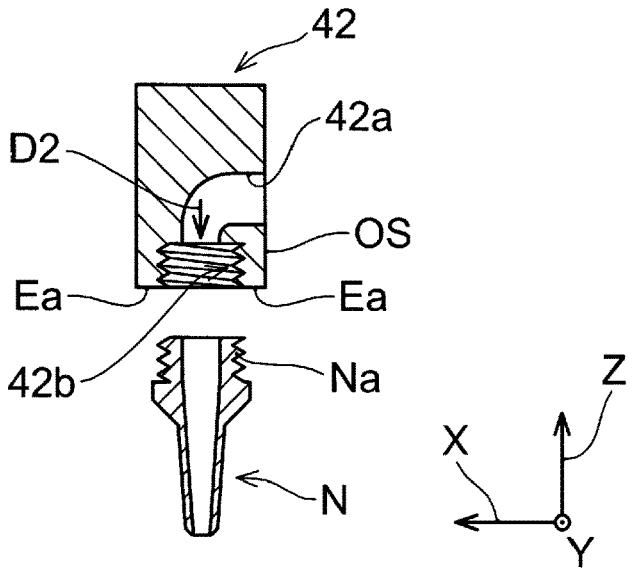
FIG. 8(C) shows a lateral cross-sectional view illustrating a state in which the nozzle is detached from the second portion shown in FIG. 8(A).

The hollow part 41*b* of the first portion 41 has an inside dimension such that the second portion 42 can be fitted into the hollow part 41*b*. In the Embodiment, as shown in FIGS. 3 and 4, a cross section of the hollow part 41*b* cut perpendicular to the second direction D2 is in a substantially rectangular shape. As long as the hollow part 41*b* has an inside dimension such that the second portion 42 can be fitted thereinto, the shape of the hollow part 41*b* is not particularly limited. Alternatively, the second portion 42 being adapted to the shape of the hollow part 41*b* can be used. In the Embodiment, the hollow part 41*b* is formed such that the second portion 42 may be pushed into the first portion 41 along the second direction D2. As shown in FIG. 7, the hollow part 41*b* can be formed such that the second portion 42 may be pushed into the first portion 41 along a third direction D3 being perpendicular to the first direction D1 and the second direction D2.

The nozzle N is attached to the nozzle adapter 4 when the second portion 42 to which the nozzle N is attached is fitted into the hollow part 41*b* of the first portion 41. In the second channel 42*a* of the second portion 42 being fitted into the hollow part 41*b* of the first portion 41, as shown in FIG. 5 and FIG. 6(A), the upstream end UE2 of the second channel 42*a* is opened along the first direction D1, while the downstream end DE2 of the second channel 42*a* is opened along the second direction D2.

In the embodiment, as shown in FIGS. 6(A) and (B), the second portion 42 has a nozzle connecting part 42*b* to which a nozzle N for discharging, along the second direction D2, the paste material entered is connected. As long as the nozzle connecting part 42*b* can be connected to the nozzle N, the specific structure of the nozzle connecting part 42*b* is not particularly limited. In the Embodiment, the nozzle connecting part 42*b* has a female screw. When a male screw Na being provided in the nozzle N screws into the female screw (the nozzle connecting part 42*b*), the nozzle N is attached to the second portion 42. The connection between the nozzle connecting part 42*b* and the nozzle N is not limited to a connection using a screw, and the nozzle connecting part 42*b* and the nozzle N may be connected in other manner (for example, a fitting connection).

A downstream end DE2 of the second channel 42*a* is linked to the nozzle connecting part 42*b* such that the second portion 42 communicates with the nozzle N in a case that the nozzle N is attached to the second portion 42. This makes it possible to supply the paste material being supplied to the second channel 42*a* to the nozzle N and to discharge the paste material from the nozzle N.

As described above, the shape of the second portion 42 is not limited as long as the second portion 42 can be fitted into the hollow part 41*b* of the first portion 41. In the Embodiment, the second portion 42 has a main body 42*c* being prismatic and a flange 42*d* being provided at an end being opposite to the nozzle connecting part 42*b* of the main body 42*c*. The flange 42*d* functions as an engaging part Ea to be engaged with the peripheral edge region around an opening of the hollow part 41*b* of the first portion 41. When the engaging part Ea engages with an engaged part Eb of the first portion 41 (the peripheral edge region around the upper end of the hollow part 41*b* of the first portion 41 in the Embodiment), the position of the second portion 42 in the second direction D2 is defined. As shown in FIG. 6(A), this causes the position of the downstream end DE1 of the first channel 41*a* of the first portion 41 to be aligned with that of the upstream end UE2 of the second channel 42*a*. The engaging part Ea does not necessarily have to be a part of the flange 42*d* being provided in the second portion 42, so it suffices that positioning in the second direction D2 (the gravity direction) be carried out with the second portion 42 engaging with the first portion 41 in the second direction D2. For example, as shown in FIG. 7 and FIG. 8(A) to FIG. 8(C), the engaging part Ea may be a bottom of the prismatic second portion 42 without a flange, and the engaged part Eb may be a supporting surface formed in the first portion 41 to support the bottom of the second portion 42.

As described above, in the nozzle adapter 4 in the Embodiment, the second portion 42 has the nozzle connecting part 42*b* and the first portion 41 has the hollow part 41*b* into which the second portion 42 is fitted along the second direction D2. Therefore, as shown in FIG. 5 and FIG. 6(A), when the second portion 42, to which the nozzle N is attached, is fitted into the hollow part 41*b* of the first portion 41, the nozzle N is attached to the nozzle adapter 4. Therefore, when the nozzle N is connected to the nozzle connecting part 42*b*, the nozzle N or the nozzle connecting part 42*b* does not come into contact with a paste material. Therefore, the paste material dripping due to gravity at the time of attaching or replacing the nozzle is not sandwiched between the nozzle and the nozzle connecting part. Presumably, a paste material being sandwiched between the nozzle and the nozzle connecting part is hardened by pressure and/or heat applied when the paste material is sandwiched and the above-mentioned hardened paste material between the nozzle and the nozzle connecting part comes off and is mixed into the channel. However, as described above, in the embodiment, sandwiching of the paste material is suppressed, so that the hardened paste material being mixed into the channel is suppressed. Therefore, narrowing or closing the discharge opening of the nozzle due to the cured material of the paste material mixed into the channel and remaining in the nozzle is suppressed. As a result, it is possible to suppress that the amount of the paste material being discharged from the nozzle gets lower than the preset amount, that discharged paste material is temporarily discontinuous, or that the paste material is not discharged. Using the Embodiment in a case of bonding together glass substrates of the liquid crystal panel using a paste material allows a failure in applying the paste material as described above to be avoided. Therefore, it is possible to maintain a constant cell gap defined by the hardened paste material, which is drawn onto the glass substrate. As a result, it is possible to suppress an occurrence of non-uniformity in the display area of the liquid crystal panel.

In the Embodiment, as shown in FIG. 5 and FIG. 6(A), when the nozzle adapter 4 is assembled into the application apparatus A, the second direction D2 in which the second portion 42 is fitted into the first portion 41 corresponds to the vertically downward orientation. Accordingly, for example, at the time of replacing the nozzle N, the paste material entered remaining in the first channel 41*a* after the second portion 42 is detached from the hollow part 41*b*, drips in the vertically downward orientation along the inner surface IS of the hollow part 41*b* from the downstream end DE1 of the first channel 41*a*. In the Embodiment, the second direction D2 corresponds to the vertically downward orientation and the second portion 42, to which the newly replaced nozzle N is attached, is fitted along the same direction as the direction in which the paste material entered drips. Even in a case that the cured material caused by the dripped paste material is produced on the inner surface IS of the hollow part 41*b* or already exists thereon, the upstream end UE2 of the second channel 42*a* of the second portion 42 passes above the downstream end DE1 of the first channel 41*a*. Therefore, when the second portion 42 is fitted, the possibility that the cured material enters the channel 42*a* is low. Accordingly, it is suppressed that the cured material is mixed into the first channel 41*a* and the second channel 42*a*. Thus, it is possible to remarkably reduce the possibility that the nozzle N gets clogged by the cured material, or the possibility that the cured material is discharged from the discharge opening of the nozzle N.

Moreover, in the Embodiment, in order to replace the nozzle N, it suffices that the nozzle N is attached to the second portion 42 in a state in which the second portion 42 is detached from the application apparatus A (the first portion 41), and then, the second portion 42, to which the nozzle N has been attached, is attached to the application apparatus A (the hollow part 41*b* of the first portion 41). Therefore, it is not necessary to screw the small sized nozzle N into a screw hole, which location is hard to be confirmed in the application apparatus A, of the arm 41*e*, as in a conventional case. Therefore, attaching/detaching the nozzle N from/to the application apparatus A is easy, making it possible to dramatically improve the workability of attaching or replacing the nozzle N.

In the Embodiment, as shown in FIG. 5 and FIG. 6(A), the first portion 41 has a through hole 41*f* linearly penetrating between the hollow part 41*b* and the exterior of the first portion 41. In the Embodiment, the nozzle adapter 4 further comprises a pressing member 44 for pressing the second portion 42 against the first portion 41 from the exterior of the first portion 41 via the through hole 41*f*. In other words, the pressing member 44 presses the second portion 42 against an inner surface IS of the hollow part 41*b* of the first portion 41, at which the downstream end DE1 of the first channel 41*a* is opened. This allows the inner surface IS of the hollow part 41*b* and an outer surface OS of the second surface 42 to be in close contact with each other such that the downstream end DE1 of the first channel 41*a* being formed on the inner surface IS of the hollow part 41*b* joins to the upstream end UE2 of the second channel 42*a* being formed on the outer surface OS of the second portion 42. Therefore, leaking of a paste material where the first channel 41*a* and the second channel 42*a* continue can be suppressed.

The structure of the pressing member 44 is not particularly limited as long as the second portion 42 can be pressed against the inner surface IS of the hollow part 41*b*. In the Embodiment, as shown in FIGS. 5 and 6, the pressing member 44 comprises a male screw to be screwed into a female screw being provided in the through hole 41*f*. The length of the shaft of the pressing member 44 having a male screw is longer than the length of the through hole 41*f* in the shaft direction. As shown in FIG. 6, when the pressing member 44 having a male screw is inserted into the through hole 41*f* having a female screw and rotated in a state in which the second portion 42 is fitted into the hollow part 41*b*, the second portion 42 can be easily pressed. For example, the pressing member 44 may comprise an elastic member, such as a spring, to press the second portion 42 toward the inner surface IS of the hollow part 41*b*.

In a configuration in which the second portion 42 is pressed against the inner surface IS of the hollow part 41*b* by the pressing member 44, a clearance can be provided between the inner surface IS of the hollow part 41*b* and the outer surface OS of the second portion 42. Therefore, the resistance is considerably reduced at the time of fitting the second portion 42 into the hollow part 41*b* along the second direction D2. Thus, it becomes easy to fit the second portion 42 into the hollow part 41*b*. Moreover, even in a case that interior dimensions of the hollow part 41*b* decrease or exterior dimensions of the second portion 42 increase in accordance with the dimensional tolerance at the time of forming the hollow part 41*b* or the second portion 42, as long as it is within a range that the second portion 42 can be fitted into the hollow part 41*b* by force fitting, the pressing member 44 makes it possible to cause the first channel 41*a* and the second channel 42*a* to continue. The second portion 42 can be pressed and fitted into the hollow part 41*b* without providing a clearance between the inner surface IS of the hollow part 41*b* and the outer surface OS of the second portion 42.

In the Embodiment, as shown in FIG. 5 and FIG. 6(A), the through hole 41*f* is formed along the first direction D1. When the pressing member 44 advances through the interior of the through hole 41*f*, the inner surface IS of the hollow part 41 and the outer surface OS of the second portion 42 are easily in close contact with each other. The forming direction of the thorough hole 41*f* is not limited to the first direction D1 as long as the pressing member 44 can press the second portion 42 against the inner surface IS of the hollow part 41*b*. For example, with a through hole being formed along the third direction D3 being perpendicular to the first direction D1 and the second direction D2, the pressing member 44 moving through the interior of the through hole along the third direction D3 can cause the second portion 42 to be moved toward the inner surface IS of the hollow part 41*b*.

Figure 9:
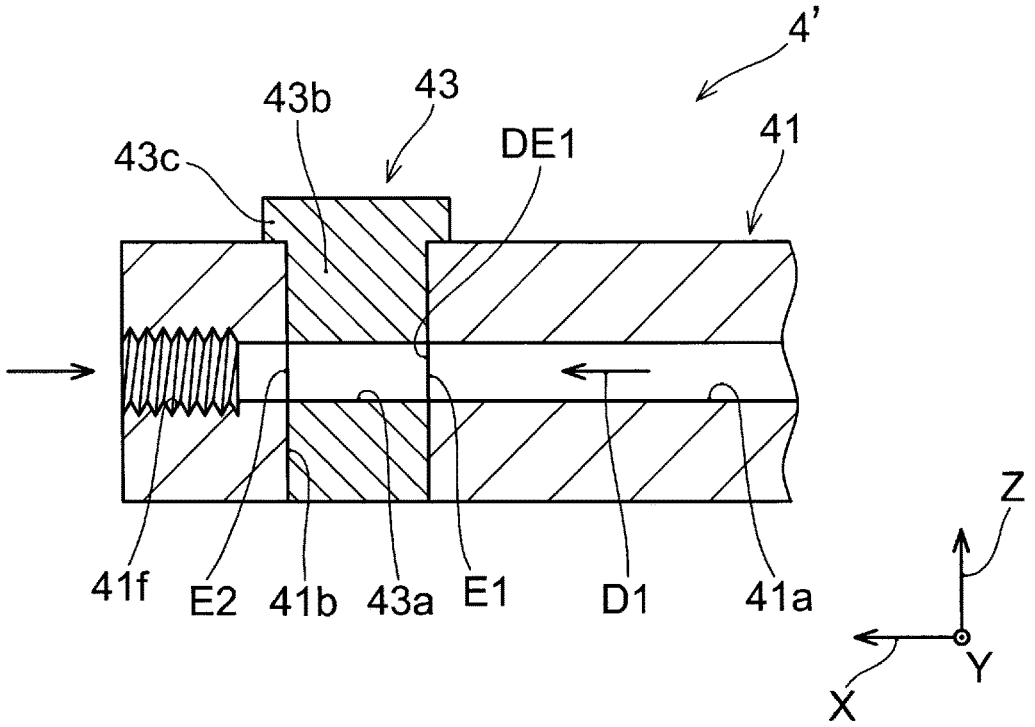
FIG. 9 shows a lateral cross-sectional view illustrating a state in which a third portion is fitted into a hollow part of a first portion of a nozzle adapter set according to one Embodiment of the invention.

A structure (a nozzle adapter set 4') in which the second portion 42 is detached from the first portion 41 of the nozzle adapter 4 and a third portion 43 being penetrated by a third channel 43*a* is attached to the first portion 41 is also one Embodiment of the invention (see FIG. 9). The third portion 43 is fitted into the hollow part 41*b* of the first portion 41 in order to fill a paste material into the storage portion 5 from the exterior of the first portion 41 via the first channel 41*a*. The third portion 43 is a member to be fitted to the hollow part 41*b* in replacement of the second portion 42 of the nozzle adapter 4. The third portion 43 is a member constituting the nozzle adapter set like the second portion 42.

In the Embodiment, as shown in FIG. 9, a first end E1 of the third channel 43*a* of the third portion 43 is opened at an outer surface of the third portion 43 such that the first end E1 of the third channel 43*a* joins to the downstream end DE1 of the first channel 41*a* in a case that the third portion 43 is fitted into the hollow part 41*b*. A second end E2 of the third channel 43*a* of the third portion 43 is opened at the outer surface of the third portion 43 such that the third channel 43*a* continues to the through hole 41*f* in a case that the third portion 43 is fitted into the hollow part 41*b*. In other words, the second end E2 is opened at the outer surface of the third portion 43 toward the through hole 41*f*. In this way, the through hole 41*f* communicates with the first channel 41*a* via the third channel 43*a* in a case that the third portion 43 is fitted into the hollow part 41*b*. Therefore, for example, using an apparatus (not shown) to fill a paste material, the paste material can be filled toward the storage portion 5 from the through hole 41*f* (toward the direction being opposite to D1 as shown). Filling of a paste material is easy when the channel for the paste material to be filled is linear, so that the through hole 41*f* is preferably formed linearly along the first direction D1. In this case, it is preferable that the third channel 43*a* is also formed linearly so as to connect the through hole 41*f* and the first channel 41*a* along the first direction D1.

Figure 10:
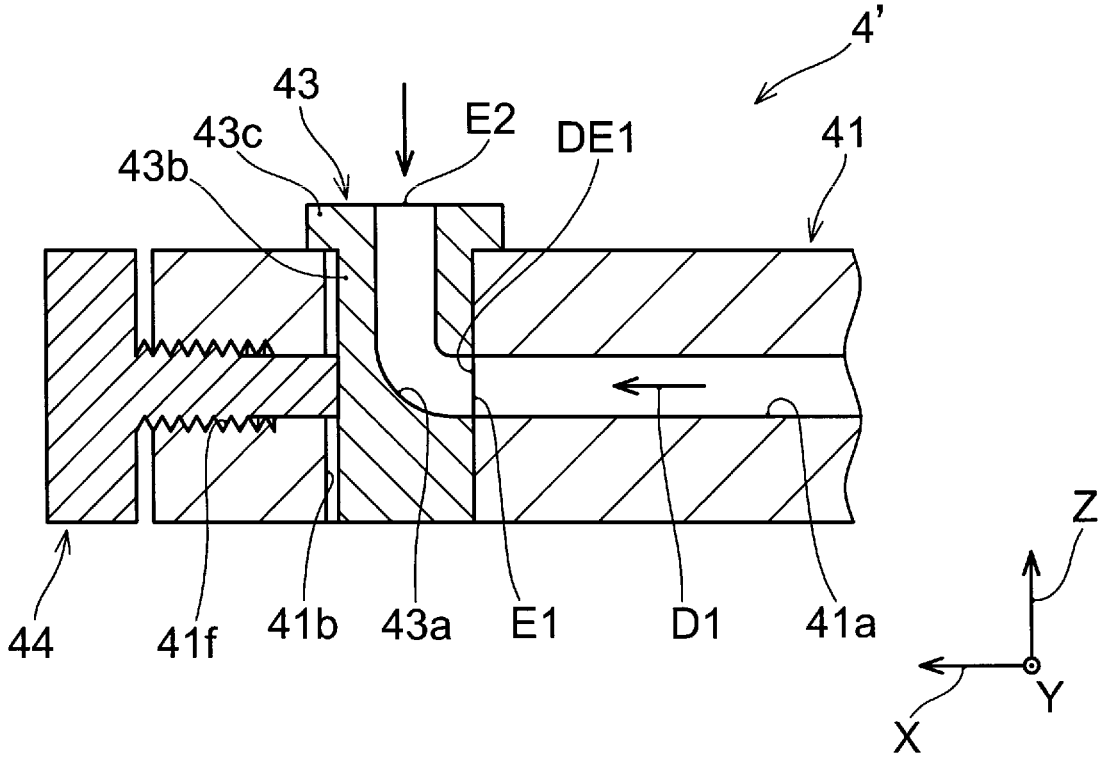
FIG. 10 shows a lateral cross-sectional view of a variation of the third portion being fitted into the hollow part of the first portion of the nozzle adapter set according to one Embodiment of the invention.

As shown in FIG. 10, the third portion 43 may be configured that when the third portion 43 is fitted into the hollow part 41*b*, the first end E1 of the third channel 43*a* of the third portion 43 is provided at a position at which the first end E1 is joined to the downstream end DE1 of the first channel 41*a*, the third channel 43*a* does not continue to the through hole 41*f*, and the second end E2 of the third channel 43*a* is opened at the outer surface of the third portion 43 toward a direction being perpendicular to the first direction D1. The direction being perpendicular to the first direction D1 may be not only the fitting direction of the second portion 42 (downward in FIG. 10) or a direction being opposite to the fitting direction thereof (the unloading direction, or upward in FIG. 10), but also a direction being perpendicular to the fitting direction (the depth direction of the paper sheet in FIG. 10). In the Embodiment, the third portion 43 is configured to be fitted into the hollow part 41*b* along the second direction D2. However, the third portion 43 may be fitted into the hollow part 41*b* (see FIGS. 7 and 8) along the third direction D3 being perpendicular to the first direction D1 and the second direction D2, or may be fitted into a direction being opposite to the second direction D2 (upward direction shown). In the Embodiment, the third portion 43 comprises a main body 43*b* to be fitted into the hollow part 41*b* and a flange 43*c* being provided, at the end in the unloading direction of the main body 43, the flange 43*c* being extended outward from a lateral surface of the main body 43*b*. The second end E2 of the third channel 43*a* is opened at the end of the main body 43*b* in the unloading direction. In a case of the third portion 43 being configured in this way, a gap is unlikely to be produced between the downstream end DE1 of the first channel 41*a* and the first end E1 of the third channel 43*a* because of the pressing member 44. Therefore, at the time of filling a paste material, the paste material to be filled is unlikely to leak. Moreover, either at the time of applying or filling a paste material, the paste material to be applied or filled does not pass through the through hole 41*f*, into which the pressing member 44 is inserted. Therefore, it does not cause hardening of a paste material due to remaining paste material in the through hole 41*f* at the time of inserting the pressing member 44 into the through hole 41*f*, making it possible to suppress a cured paste material entering the channel even at the timing of filling a paste material.

[Summary]

(1) A nozzle adapter according to one Embodiment of the invention comprises a first portion having a first channel in which a paste material to be passed through the first portion is to flow along a first direction, and a second portion having a second channel, a paste material to be passed through the second portion entering the second channel along the first direction, the paste material entered being released from the second channel along a second direction, wherein the second portion has a nozzle connecting part to which a nozzle for discharging, along the second direction, the paste material entered is connected, a downstream end of the second channel is linked to the nozzle connecting part such that the second portion communicates with the nozzle in a case that the nozzle is attached to the second portion, the first portion has a hollow part for fitting the second portion, the hollow part being formed along the second direction, or along a third direction being perpendicular to the first direction and the second direction, and a downstream end of the first channel is linked to the hollow part such that the downstream end of the first channel joins to an upstream end of the second channel of the second portion in a case that the second portion is fitted into the hollow part.

The configuration according to (1) makes it possible to suppress a failure in applying a paste material caused by the cured material of the paste material.

(2) In the nozzle adapter of (1), the first portion may have a coupling part to be connected to a storage portion for storing a paste material, in which case, an upstream end of the first channel may be linked to the coupling part such that the upstream end of the first channel joins to the downstream end of the storage portion in a case that the storage portion is connected to the coupling part.

The configuration according to (2) makes it possible to supply a paste material to the first channel of the nozzle adapter from the storage portion by communicating the nozzle adapter with the storage portion in a case that the storage portion is coupled to the coupling part.

(3) The nozzle adapter in (1) or (2) may further comprise a storage portion for storing a paste material.

The configuration according to (3) makes it possible to supply a paste material to the first channel of the nozzle adapter from the storage portion by communicating the nozzle adapter with the storage portion.

(4) In the nozzle adapter in any one of (1) to (3), the first portion may have a through hole penetrating between the hollow part and an exterior of the first portion, in which case, preferably, the nozzle adapter may further comprises a pressing member for pressing the second portion against an inner surface of the hollow part from the exterior of the first portion via the through hole.

According to the configuration in (4), the pressing member presses the second portion against the inner surface of the hollow part of the first portion, making it possible to suppress a paste material leaking where the first channel continues to the second portion.

(5) In the nozzle adapter in (4), the pressing member may comprise a male screw to be screwed into a female screw being provided in the through hole.

According to the configuration in (5), in a state in which the second portion is fitted into the hollow part, it is possible to easily press the second portion by screwing the pressing member having the male screw into the through hole having female screw.

(6) In the nozzle adapter of (4) or (5), the through hole may be formed along the first direction.

According to the configuration in (6), the direction in which the pressing member advances through the through hole corresponds with the first direction. Therefore, the above-described configuration makes it easy to bring the first portion (the inner surface of the hollow part) and the second portion (the outer surface of the second portion) into close contact with each other.

(7) The nozzle adapter according to any one of (1) to (6) may further comprise a nozzle for discharging the paste material entered.

The configuration according to (7) makes it possible to apply the paste material entered by driving an application apparatus A, to which a nozzle comprised in a nozzle adapter is attached.

(8) A nozzle adapter set according to one Embodiment of the invention comprises a first portion having a first channel in which a paste material to be passed through the first portion is to flow along a first direction, and a second portion having a second channel, a paste material to be passed through the second portion entering the second channel along the first direction, the paste material entered being released from the second channel along a second direction, wherein the second portion has a nozzle connecting part to which a nozzle for discharging, along the second direction, the paste material entered is connected, a downstream end of the second channel is linked to the nozzle connecting part such that the second portion communicates with the nozzle in a case that the nozzle is attached to the second portion, the first portion has a hollow part for fitting the second portion, the hollow part being formed along the second direction, or along a third direction being perpendicular to the first direction and the second direction, and a downstream end of the first channel is linked to the hollow part such that the downstream end of the first channel joins to an upstream end of the second channel of the second portion in a case that the second portion is fitted into the hollow part.

The configuration according to (8) makes it possible to suppress a failure in applying a paste material caused by the cured material of the paste material.

(9) In the nozzle adapter set of (8), the first portion may have a coupling part to be connected to a storage portion for storing a paste material, in which case, an upstream end of the first channel may be linked to the coupling part such that the upstream end of the first channel joins to the downstream end of the storage portion in a case that the storage portion is connected to the coupling part.

The configuration according to (9) makes it possible to supply a paste material to the first channel of the nozzle adapter from the storage portion by communicating the nozzle adapter with the storage portion in a case that the storage portion is coupled to the coupling part.

(10) The nozzle adapter set of (8) or (9) further comprises a storage portion for storing the paste material.

The configuration according to (10) makes it possible to supply a paste material to the first channel of the nozzle adapter from the storage portion by communicating the nozzle adapter with the storage portion.

(11) In the nozzle adapter set in any one of (8) to (10), the first portion may have a through hole penetrating between the hollow part and an exterior of the first portion, in which case, preferably, the nozzle adapter may further comprises a pressing member for pressing the second portion against an inner surface of the hollow part from the exterior of the first portion via the through hole.

According to the configuration in (11), the pressing member presses the second portion against the inner surface of the hollow part of the first portion, making it possible to suppress a paste material leaking where the first channel continues to the second portion.

(12) In the nozzle adapter set in (11), the pressing member may comprise a male screw to be screwed into a female screw being provided in the through hole.

The configuration according to (12), in a state where the second portion is fitted into the hollow part, it is possible to easily press the second portion by screwing the pressing member having the male screw into the through hole having female screw.

(13) In the nozzle adapter set according to any one of (8) to (12), in a case that the first portion has a through hole penetrating between the hollow part and an exterior of the first portion, the nozzle adapter set may further comprise a third portion being penetrated by a third channel, a first end of the third channel of the third portion is being opened at an outer surface of the third portion such that the first end of the third channel joins to the downstream end of the first channel in a case that the third portion is fitted into the hollow part, and a second end of the third channel of the third portion is being opened at the outer surface of the third portion such that the third channel continues to the through hole in a case that the third portion is fitted into the hollow part.

The configuration in (13) makes it possible to make a paste material flow in a direction being opposite to the first direction via the first channel and the through hole from the exterior of the first portion, making it possible to fill a paste material into the storage portion from the exterior of the first portion.

(14) In the nozzle adapter set of any one of (11) to (13), the through hole may be formed along the first direction.

According to the configuration in (14), the direction in which the pressing member advances through the through hole corresponds with the first direction. Therefore, the above-described configuration makes it easy to bring the first portion (the inner surface of the hollow part) and the second portion (the outer surface of the second portion) into close contact with each other.

(15) The nozzle adapter set according to any one of (8) to (12), may further comprises a third portion being penetrated by a third channel, in which case a first end of the third channel of the third portion may be opened at an outer surface of the third portion such that the first end of the third channel joins to the downstream end of the first channel in a case that the third portion is fitted into the hollow part, and a second end of the third channel of the third portion may be opened at the outer surface of the third portion toward a direction being perpendicular to the first direction in a case that the third portion is fitted into the hollow part.

The configuration according to (15) makes it possible to fill a paste material into the storage portion from the exterior of the first portion via an aperture end (the second end) being opened in a direction being perpendicular to the first direction in the third portion.

(16) The nozzle adapter set according to any one of (8) to (15) may further comprise a nozzle for discharging the paste material entered.

The configuration according to (16) makes it possible to apply the paste material entered by driving an application apparatus A, to which a nozzle comprised in a nozzle adapter is attached.

(17) A application apparatus according to one Embodiment of the invention holds the first portion of the nozzle adapter in any one of (1) to (7) such that the second direction corresponds to a vertically downward orientation.

The configuration according to (17) makes it possible to easily fit the second portion into the hollow part of the second portion by moving the second portion in a vertically downward orientation (the second direction) toward the hollow part.

(18) A application apparatus according to one Embodiment of the invention holds the first portion of the nozzle adapter set in any one of (8) to (16) such that the second direction corresponds to a vertically downward orientation.

The configuration according to (18) makes it possible to easily fit the second portion into the hollow part of the second portion by moving the second portion in a vertically downward orientation (the second direction) toward the hollow part.

(19) A application system according to one Embodiment of the invention comprises an application apparatus in (17), and a moving mechanism, wherein the moving mechanism changes the relative position between the nozzle adapter and a subject onto which the paste material is to be applied via the nozzle adapter in at least one of a horizontal direction and a vertical direction.

The configuration in (19) makes it possible to suppress a failure in applying a paste material caused by the cured material of the paste material while drawing of the paste material onto the subject.

(20) A application system according to one Embodiment of the invention comprises an application apparatus in (18), and a moving mechanism, wherein the moving mechanism changes the relative position between the nozzle adapter set and a subject onto which the paste material is to be applied via the nozzle adapter set in at least one of a horizontal direction and a vertical direction The configuration in (20) makes it possible to suppress a failure in applying a paste material caused by the cured material of the paste material while drawing of the paste material onto the subject.

The invention is not limited to the above-described Embodiment, so that various changes are possible thereto within the scope shown in the claims. Moreover, Embodiments that can be obtained by appropriately combining the technical features disclosed in the above-described Embodiment can also fall within the technical scope of the invention.

DESCRIPTION OF REFERENCE NUMERALS

4 Nozzle adapter
4' Nozzle adapter set
41 First portion
41*a* First channel
41*b* Hollow part
41*c* Coupling part
42 Second portion
42*a* Second channel
42*b* Nozzle connecting part
43 Third portion
43*a* Third channel
5 Storage portion
51 End of storage portion
A Application apparatus
D1 First direction
D2 Second direction
D3 Third direction
DE1 Downstream end of first channel
DE2 Downstream end of second channel
N Nozzle
S Application system UE1 Upstream end of first channel UE2 Upstream end of second channel

The invention claimed is:

1. A nozzle adapter comprising:

a first portion having a first channel in which a paste material to be passed through the first portion is to flow along a first direction; and a second portion having a second channel, the paste material to be passed through the second portion entering the second channel along the first direction, the paste material entered being released from the second channel along a second direction, wherein the second portion has a nozzle connecting part to which a nozzle for discharging, along the second direction, the paste material entered is connected;

a downstream end of the second channel is linked to the nozzle connecting part in the second direction such that the second portion communicates with the nozzle in a case that the nozzle is attached to the second portion;

the first portion has a hollow part for fitting the second portion, the hollow part being formed along the second direction, or along a third direction being perpendicular to the first direction and the second direction;

a downstream end of the first channel is linked to the hollow part in the first direction at an inner surface of the hollow part;

an upstream end of the second channel is opened in the first direction at an outer surface of the second portion; and when the second portion is fitted into the hollow part, the upstream end of the second channel joins to the downstream end of the first channel.

2. The nozzle adapter according to claim 1, wherein the first portion has a through hole penetrating between the hollow part and an exterior of the first portion, the nozzle adapter further comprising a pressing member to be inserted into the through hole from the exterior of the first portion toward the hollow part, in a case that the pressing member is inserted into the through hole and a tip of the pressing member contacts and presses the second portion, the second portion is pressed against the inner surface of the hollow part to be fixed to the first portion.

3. The nozzle adapter according to claim 1, further comprising a nozzle for discharging the paste material entered.

4. An application apparatus, comprising the nozzle adapter according to claim 1, wherein the application apparatus holds the first portion of the nozzle adapter such that the second direction corresponds to a vertically downward orientation.

5. An application system comprising:

an application apparatus according to claim 4; and a moving mechanism, wherein the moving mechanism changes the relative position between the nozzle adapter and a subject onto which the paste material is to be applied via the nozzle adapter in at least one of a horizontal direction and a vertical direction.

6. The nozzle adapter according to claim 1, wherein the first portion comprises a base, and an arm extending from the base in the first direction.

7. The nozzle adapter according to claim 6, wherein the downstream end of the first channel penetrating the arm is opened in the first direction at the inner surface of the hollow part penetrating the arm along the second direction.

8. The nozzle adapter according to claim 6, wherein the base has a coupling part to be connected to a storage portion for storing the paste material, and an upstream end of the first channel is linked to the coupling part such that the upstream end of the first channel joins to the downstream end of the storage portion in a case that the storage portion is connected to the coupling part.

9. The nozzle adapter according to claim 8, further comprising a storage portion for storing the paste material.

10. The nozzle adapter according to claim 9, wherein an end of the storage portion has a male screw structure and is being screwed into the coupling part having a female screw structure.

11. A nozzle adapter set, comprising:

a first portion having a first channel in which a paste material to be passed through the first portion is to flow along a first direction;

a second portion having a second channel, the paste material to be passed through the second portion entering the second channel along the first direction, the paste material entered being released from the second channel along a second direction; and a third portion being penetrated by a third channel, wherein the second portion has a nozzle connecting part to which a nozzle for discharging, along the second direction, the paste material entered is connected;

a downstream end of the second channel is linked to the nozzle connecting part in the second direction such that the second portion communicates with the nozzle in a case that the nozzle is attached to the second portion;

the first portion has a hollow part for fitting any one of the second portion and the third portion, the hollow part being formed along the second direction, or along a third direction being perpendicular to the first direction and the second direction; and the first portion has a through hole penetrating between the hollow part and an exterior of the first portion, a downstream end of the first channel is linked to the hollow part in the first direction at an inner surface of the hollow part;

an upstream end of the second channel is opened in the first direction at an outer surface of the second portion; and when the second portion is fitted into the hollow part, the upstream end of the second channel joins to the downstream end of the first channel, a first end of the third channel of the third portion is being opened at an outer surface of the third portion such that the first end of the third channel joins to the downstream end of the first channel in a case that the third portion is fitted into the hollow part; and a second end of the third channel of the third portion is being opened at the outer surface of the third portion such that the third channel continues to the through hole in a case that the third portion is fitted into the hollow part.

12. An application apparatus, comprising the nozzle adapter set according to claim 11, wherein the application apparatus holds the first portion of the nozzle adapter set such that the second direction corresponds to a vertically downward orientation.

13. An application system comprising:

an application apparatus according to claim 12; and a moving mechanism, wherein the moving mechanism changes a relative position between the nozzle adapter set and a subject onto which the paste material is to be applied via the nozzle adapter set in at least one of a horizontal direction and a vertical direction.

14. A nozzle adapter set, comprising:

a first portion having a first channel in which a paste material to be passed through the first portion is to flow along a first direction;

a second portion having a second channel, the paste material to be passed through the second portion entering the second channel along the first direction, the paste material entered being released from the second channel along a second direction; and a third portion being penetrated by a third channel, wherein the second portion has a nozzle connecting part to which a nozzle for discharging, along the second direction, the paste material entered is connected;

a downstream end of the second channel is linked to the nozzle connecting part in the second direction such that the second portion communicates with the nozzle in a case that the nozzle is attached to the second portion;

the first portion has a hollow part for fitting any one of the second portion and the third portion, the hollow part being formed along the second direction, or along a third direction being perpendicular to the first direction and the second direction; and a downstream end of the first channel is linked to the hollow part in the first direction at an inner surface of the hollow part;

an upstream end of the second channel is opened in the first direction at an outer surface of the second portion; and when the second portion is fitted into the hollow part, the upstream end of the second channel joins to the downstream end of the first channel, a first end of the third channel of the third portion is being opened at an outer surface of the third portion such that the first end of the third channel joins to the downstream end of the first channel in a case that the third portion is fitted into the hollow part; and a second end of the third channel of the third portion is being opened at the outer surface of the third portion toward a direction being perpendicular to the first direction in a case that the third portion is fitted into the hollow part.

15. An application apparatus, comprising the nozzle adapter set according to claim 14, wherein the application apparatus holds the first portion of the nozzle adapter set such that the second direction corresponds to a vertically downward orientation.

16. An application system comprising:

an application apparatus according to claim 15; and a moving mechanism, wherein the moving mechanism changes a relative position between the nozzle adapter set and a subject onto which the paste material is to be applied via the nozzle adapter set in at least one of a horizontal direction and a vertical direction.

* * * * *